United States Patent [19]

Jefferson et al.

[11] 4,222,685

[45] Sep. 16, 1980

[54] POND SEALING

[75] Inventors: Gene Jefferson, San Jose, Calif.; Martin Laborde, Santiago, Chile

[73] Assignees: Corporation de Fomento de la Produccior, Ojai, Calif.; Corporacion De Fomento De La Produccion, Santiago, Chile

[21] Appl. No.: 22,369

[22] Filed: Mar. 20, 1979

[51] Int. Cl.[2] ..... E02B 3/00; E02D 3/12

[52] U.S. Cl. ..... 405/270; 405/263

[58] Field of Search ..... 405/52, 57, 270, 263; 52/169.14

[56] References Cited

U.S. PATENT DOCUMENTS

| | | | |
|---|---|---|---|
| 2,154,233 | 4/1939 | Donaldson | 405/270 X |
| 2,159,954 | 5/1939 | Powell | 405/270 |
| 2,277,286 | 3/1942 | Bechtner | 52/169.14 X |
| 2,333,287 | 11/1943 | Baird | 405/270 X |
| 3,180,097 | 4/1965 | McDowell | 405/270 |
| 3,774,402 | 11/1973 | Muzychenko | 405/263 |
| 4,030,307 | 6/1977 | Avedisian | 405/270 |

FOREIGN PATENT DOCUMENTS

| | | | |
|---|---|---|---|
| 220893 | 10/1968 | U.S.S.R. | 405/270 |

*Primary Examiner*—Stephen J. Novosad

*Attorney, Agent, or Firm*—Kenneth J. Hovet

[57] ABSTRACT

A method of providing a substantially impermeable lining to the bottom of an earthen pond using native soil. Such soil is classified and formed into a slurry containing fine particles of predominately five or less micron size. The pond bottom is covered with a first layer of the slurry which is allowed to dry to a point where large crack patterns develop. The cracks are filled with a second layer of the slurry. More layers may be applied to form a final lining having the desired permeability for the particular application.

17 Claims, 4 Drawing Figures

POND SEALING

BACKGROUND OF THE INVENTION

1. Field of the Invention

This invention pertains to the sealing of water confining earth formations and, more specifically, to the use of local soil materials in the formation of a water barrier.

2. Description of the Prior Art

The prevention of water leakage through ground formations such as dams, dikes, wells, ponds, reservoirs, canals and the like with bentonite and other expanding lattice clays has long been known. The magnitude in size of such formations, however, and the concomittant large quantities of clay needed to seal the formations has made cost a prohibitive factor. This is particularly true when the appropriate clays and/or other sealing materials must be transported to the ground formation site.

In the case of solar brine concentration ponds, U.S. Pat. No. 3,774,402 discloses the use of readily available phosphate slimes to reduce the permeability of the pond bottom. This is an inexpensive improvement which obviates the disadvantage of clay linings which deteriorate upon exposure to salt solutions. However, the necessary steps of slime recovery, concentration and application are significant detriments to the large-scale use of such a technique.

Another patent that utilizes inexpensive materials available in large quantities is U.S. Pat. No. 3,732,697. This patent discusses the use of industrial liquid waste materials mixed with loose earth to form a lining for waste disposal evacuations. The purpose of the lining is to prevent contamination with adjacent underground water supplies. Obviously, such technique would not be available at remote locations or other areas that are not near waste disposal facilities.

Reconstituted shale found beneath a limestone quarry has been shown to have utility as an impermeable liner for sanitary land fills in U.S. Pat. No. 4,030,307. Unfortunately, such shale does not exist everywhere one wishes to construct an earth formation for the containment of water. Additionally, the shale must be mined by drilling, blasting and crushing followed by screening. Unquestionably, these operations on a commercial scale require massive expenditures for labor and equipment.

SUMMARY OF THE INVENTION

The present invention provides an effective inexpensive technique for inhibiting hydraulic leakage from earth formations. It has been found that local soil may be utilized as a barrier material when properly classified and applied as a slurry in two or more layers to form a lining. The lining has a coefficient of impermeability in the range of $10^{-7}$ cm per second and is sufficiently plastic to withstand seismic tremors or other earth movement when applied in accordance with the present invention.

The invention involves the classification of soil obtained proximate the earth formation site for use as a slurry to effectively cover the area exposed to water. The slurry should contain solids of which at least about 35 weight percent soil particles are five micron or less diameter. The particular type of soil is not critical to the practice of this invention.

The slurry is applied as a first coating and allowed to dry below equilibrium level until a crack pattern forms throughout the layer. The cracks should have openings sufficient to allow access of additional slurry applied as a second coating. The second coating may be allowed to thicken and the formation put into use or the procedure may be repeated until a lining is formed having a thickness sufficient to impart the desired permeability.

When the slurry contains minimal amounts of clay-type minerals and is composed primarily of nonswelling materials such as very fine sands or lime muds, the slurry is applied as a coating and allowed to dry to the optimum water content as determined by any accepted test which determines the relationship between humidity of the specific material, maximum dry density, and the compactive effort required to reach the maximum dry density. Following drying, each layer should then be compacted by earth compaction equipment. Sufficient layers are thus formed to yield a total thickness having a permeability effective for the particular earth formation and fluid being contained.

DESCRIPTION OF PREFERRED EMBODIMENTS

Figure 1:
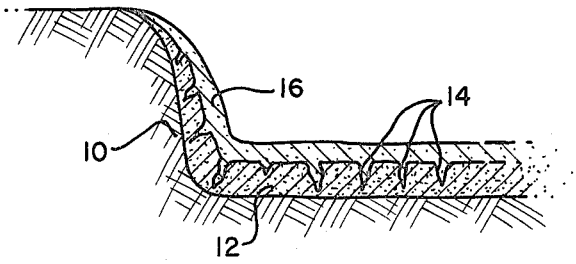
FIG. 1 is an enlarged fragmentary schematic view of the basic elements of the invention.

With reference to the drawings and, more particularly, to FIG. 1 thereof, the essential elements of the invention are depicted in schematic form. Intially, an earth formation 10 is constructed which may be a pond evacuation, dike, dam, canal, embankment, or the like, all for the primary purpose of confining hydraulic fluids.

Soil from the construction formation area or available soil reasonably near the formation is used as the lining material to seal the formation from hydraulic leakage. An essential aspect of the invention is to use such local soil and segregate fine particles therefrom having a particle size of less than about five microns.

It has been found that such fine particles can function to produce a suitably impervious lining to the flow of fluids provided the particles are applied in adequate thicknesses and in accordance with the techniques of this invention. This discovery is important since it obviates the necessity of requiring the well-known expanding lattice clays which were previously thought of as being necessary to prevent the seepage of water. With the present invention, sandy soil can even be utilized provided such contains fine sand particles of less than about five microns.

To achieve the desired segregation of fine particles from native soils, it may be necessary to process such soil through lump breaking and pug milling processes followed by various means for concentrating the comminuted particles so that the materials applied to the earth formation as a lining will contain at least about 35 weight percent of soil particles having less than five micron diameter when dry. This corresponds to an aqueous slurry concentration of about a five weight percent solids. Such concentration and separation equipment are well known in the art and may comprise cyclones, hydroseparators, or elutriators wherein an upper current of fluid will suspend the fine particles and allow them to flow as overflow into thickeners or settling ponds. Particles greater than five microns can be appropriately blended with the finer particles or utilized for other purposes such as filling materials in road beds, foundations, canals or the like which are typically part of the overall earth formation construction project.

The simplest and least expensive way to apply the lining material to the earth formation is as a pumpable water slurry. Such slurry can be achieved by simply settling the fine materials in a holding pond and decanting the excess water. It is important that excess waters be removed to avoid unwanted segregation of the coarser and finer particles thereby forming a faulty unsatisfactory lining. Alternatively, lamela type thickeners may be used in the aforementioned slurry concentration step.

A particularly advantageous slurry concentration suitable for use with the present invention contains 15–50 weight percent soil particles with the majority having less than five micron diameter. The remaining particles preferably do not exceed a diameter of 250 microns. Such a slurry is pumped to the earth formation and applied as a first coating shown by reference numeral 12 over the entire water confining area of the formation. It is desirable to have the layer thickness as even as possible and compaction means, such as rollers or the like, may be utilized to achieve a uniform thickness and compaction after drying.

The first layer is allowed to dry to a point below its equilibrium moisture content until fracturing of the layer occurs and a crack pattern 14 is formed throughout. Such cracks should be of sufficient size to enable a subsequent slurry application to enter and fill the cracks. After the cracks 14 have formed in the first layer, a second layer 16 of the aforementioned slurry is applied in the same manner over the first coating. Depending on the end use of the earth formation, the two coatings may have sufficient impermeability to retain the desired fluids.

When the slurry is composed of nonswelling materials, compaction of the layers formed after partial drying of the slurry will yield a higher degree of impermeability than is obtainable without compaction. Such layers are dried to the optimum water content and then compacted to obtain the maximum dry density. The thickness of each layer is determined by the above tests and by the type of earth compaction equipment chosen, and the total thickness by the desired degree of impermeability. It has also been noted that the later placement of salt layers on the pond lining can add to its impermeability. In such case, the application of additional slurry to fill the interstices between the salt particles is beneficial. In a solar pond, there is commonly sufficient salt to form a lining therewith followed by a soil/water slurry application. The slurry will fill the interstices between the salt particles in a manner somewhat similar to the crack filling procedure of the present invention.

Figure 2:
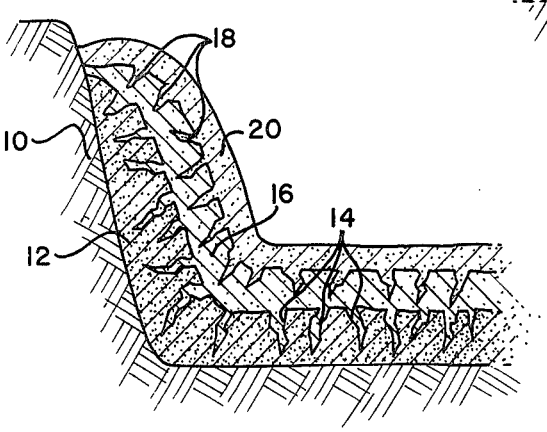
FIG. 2 is an enlarged fragmentary schematic view of a first alternative embodiment of the invention.

Referring now to FIG. 2, a first alternative embodiment is shown wherein the earth formation 10 is covered with a first coating of the aforementioned slurry 12. The slurry is allowed to dry below its equilibrium moisture content and form cracks 14. Such cracks have openings sufficiently large to allow access of additional slurry. The second coating 16 is applied to fill the cracks 14 and form a second layer over the first coating. The second ocating is allowed to dry below its equilibrium moisture content such that cracks will form in the same manner as with the first coating. Such cracks are shown by reference numeral 18.

A third coating 20 of the slurry is applied over the second coating and into the cracks 18. In this manner a thicker lining is formed having the advantage of being interlocked between coatings.

Figure 3:
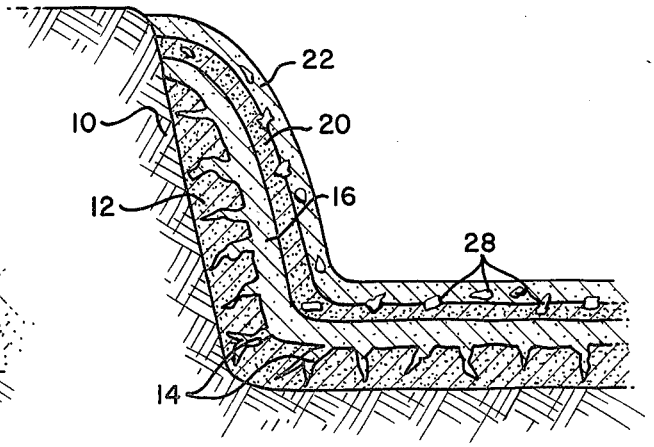
FIG. 3 is an enlarged fragmentary schematic view of a second alternative embodiment of the invention.

As shown in FIG. 3 the third coating may be applied over the second coating before the second coating completely dries and forms a crack pattern. In this case, interlocking of the layers is not necessary. Similarly, an optional fourth coating may be applied over the third coating shown by reference numeral 22 in FIG. 3. Also, rocks or other support material 28 may be added on top of the dried layers to provide reinforcement therebetween.

Figure 4:
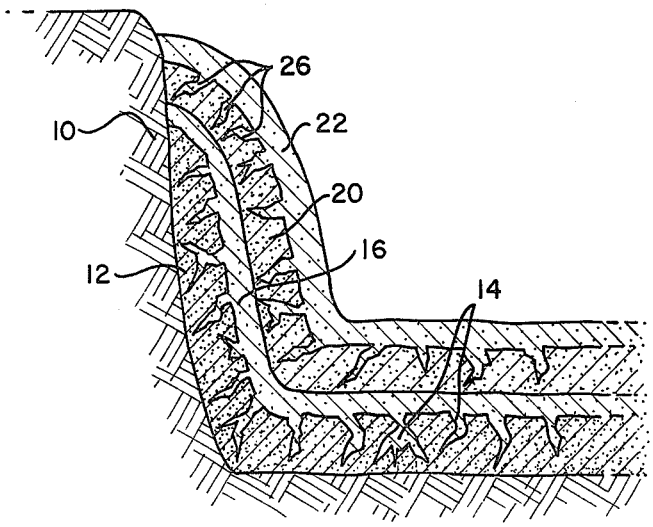
FIG. 4 is an enlarged fragmentary schematic view of a third alternative embodiment of the invention.

As best shown in FIG. 4, the third coating 20 may be allowed to dry and form a crack pattern 26 in which case the fourth coating 22 will be applied in a manner to fill such cracks.

It will be appreciated that various mixtures of soil particles may be utilized depending upon the specific type of native soil being utilized. For example, if the native soil contains a large quantity of fine expanding lattice clays, it is possible that less quantities of such will be necessary and a greater proportion of larger particles may be utilized.

In some cases and in addition to at least 35 weight percent particles of less five micron, the maximum particle size suitable to achieve the desired $10^{-7}$ cm/sec. coefficient of permeability may be a 250 micron particle size. It will be noted, however, that to impart structural strength to the lining, it may be desirable to add particle sizes of $\frac{1}{4}''$ or larger, such as that typical of rock or gravel. Note reinforcements 26 in FIG. 3. In this way strength is provided for the lining to form a foundation for vehicles or the like. Similarly, the specific embodiment hereinabove described, and the thickness of each layer, will be dictated by the fluid being contained, the depth thereof, and the permissable leakage rate for the environment in which the earth formation is constructed.

To effect the desired coating consistency the slurry should contain at least 15 volume percent solids. Also, any concentration of solids greater than about 65 volume percent will render the pumping of such impractical.

In general, the segregated soil particles should have an overall coefficient of permeability in the range of 1.0–9.0 $10^{-7}$ cm/sec. and, preferably, within the range of about 1.5–2.5 $10^{-7}$ cm/sec. In the instance where the native soil has a large proportion of fine materials, a mixture of particles having about 140–300 micron diameters with the balance having less than 3 micron provides a highly impermeable lining thereby necessitating fewer coatings whereby the overall leakage criteria may be satisfied with the FIG. 1 embodiment.

The following examples are given as a means of illustrating the invention and the applicability of such to various circumstances. Such examples are not to be taken as limiting the invention in any manner.

EXAMPLE I

It was determined that a large quantity of clay-like minerals could be obtained from a stream of fines presently discarded in the tailings pond from an ore processing mill. A separation system consisting of hydrocyclones and elutriators was constructed to separate a portion of the minerals from this stream, which originally comprised 15 weight percent of particles less than five micron size. The separated slurry product was tested in a falling head permeameter and permeabilities of $1.5\text{-}2.5\times10^{-7}$ cm/sec., within the acceptable range for the proposed pond lining, were obtained.

A series of small test ponds of 2×2 meters in size were then constructed on a sandy base. The final pilot study was conducted in a pond of 20 meters in size. The initial layer of minerals was implaced as a water slurry of 40 percent solids by volume to a depth of 40 cm. This layer was allowed to dry to a point below the equilibrium moisture content as determined by laboratory tests until fracturing of the clay layer had progressed to the point that filling by subsequent layers of slurry was assured.

This process was repeated until the specified dry thickness was obtained, in this case, 40 cm. The final layer was added and immediately thereafter, a test solution resembling the normal plant solutions was added to the pond. During the construction of the pond bottom, a portion of the slurry added to the pond was spread over the sidewalls until an equal dry thickness had been formed.

The pond bottom permeability was determined by a salts inventory method over a period of four months using all constituents in the test solution as tracers. The results yielded permeabilities of $1.5\text{-}2.5\times10^{-7}$ cm/sec. No indication of pond bottom deterioration could be detected after nine months of service with an unsaturated solution present in the pond. This permeability is equivalent to a leakage rate of 0.2 mm/day/$m^2$ where the bottom thickness and liquid depths are one meter each.

The mineral particles used for the pilot studies was determined by x-ray diffraction and TEM to have the following composition:

| Wt. % | Material |
|---|---|
| 20-35 | Montmorrillonite |
| 10-15 | Attapulgite |
| 5-10 | Talc |
| 20-25 | Feldspar |
| 5-10 | Quartz |
| 3-5 | Calcite |
| 3-5 | Gypsum |

EXAMPLE II

A second test was conducted in the same manner as Example I at a different location. The minerals consisted of:

| Wt.% | Material |
|---|---|
| 3-5 | Kaolin |
| 3-5 | Illite |
| 3-5 | Quartz |
| 3-5 | Feldspar |
| 85-90 | Amorphous (finely divided) |
| Trace | Halloysite, Attapulgite, Sepiolite |

The results were the same as those reported in Example I.

In Example I the minerals contained about 50% particles between 0.5 and 2 microns, and the rest was predominantly 50 to 100 mesh particles. In Example II, the minerals contained about 60% of less than 5 microns material, with the remainder being predominantly up to 80 mesh.

It will be appreciated that slurry drying must be carefully followed, since should a second layer of slurry be added prior to adequate drying to the equilibrium humidity, the permeability of the layer may be up to ten times greater than the minimum obtainable. Drying to the equilibrium humidity is also important if the maximum possible strength or load resistance is to be developed.

Crack formation in a drying slurry containing any appreciable quantity of expanding lattice type clays is a normal occurence, with such cracks commencing as soon as a free water layer no longer covers the clay. However, the fractures remain quite narrow until a water content near or below the equilibrium humidity is reached. When the slurry contains appreciable substances imparting a thixotropic behavior to the mixture, the slurry may fail to form cracks more than ⅛" in width. In such case an adequate base will not be formed.

While the invention has been described with respect to preferred embodiments, it will be apparent that other modifications and improvements may be made without departing from the intents and purposes of the invention. Accordingly, the invention is not to be limited by the specific embodiments, but only by the scope of the appended claims.

I claim:

1. A method of constructing a substantially impervious earthen pond comprising:

shaping the sides and base of a pond basin;

covering said basin with a first coating of slurry containing at least about five weight percent of soil particles having less than five micron diameter, said particles originating from soil proximate the excavation;

drying said first coating to form cracks therein;

applying at least a second coating over said first coating and into said cracks to cover said basin with a lining substantially impervious to hydraulic leakage.

2. The method of claim 1 wherein substantially all of said particles do not exceed a diameter of about 250 micron.

3. The method of claim 1 wherein said slurry contains from about 15 to 65 volume percent soil particles.

4. The method of claim 1 wherein said coatings have a permeability of about 1.0 to $9.0\times10^{-7}$ cm/sec.

5. The method of claim 4 wherein said coatings include large particulate matter greater than one quarter inch diameter to enhance the structural strength thereof.

6. The method of claim 1 wherein said soil particles originate from one of the group consisting of said excavation, nearby mining, available waste materials or residues.

7. The method of forming a substantially water impervious lining on the water confining surfaces of an earth formation with native soil comprising the steps of applying a slurry of said soil over the pond bottom containing greater than 15 weight percent of solid particles containing more than 35 weight percent five micron or less particles, allowing the slurry to dry below the equilibrium moisture content therein until cracks form, and filling said cracks with a second application of said slurry to form a continuous coating over said bottom.

8. The method of claim 7 wherein said second application is allowed to dry below the equilibrium moisture level and form second layer cracks; and filling said second layer cracks with a third application of said slurry.

9. The method of claim 8 wherein said slurry comprises about 15–50 weight percent particles, with a majority of said particles having less than five micron diameter with the balance comprising particles having about 140 to 300 micron diameters.

10. A method of forming a pond lining comprising:

selecting native soil proximate said pond;

comminuting said soil into a mixture of different sized particles having a sufficient concentration of particles of less than about five microns diameter to achieve an impermeability to water of about $10^{-7}$ cm/sec;

forming a slurry with said particles;

applying said slurry as a first layer to the water confining surfaces of said pond;

allowing said slurry to dry and form cracks; and, applying a second layer of said slurry into said cracks and over said first layer.

11. The method of claim 10 wherein said slurry contains at least 15 weight percent solid particles.

12. The method of claim 11 including the step of applying a third layer of slurry over said second layer.

13. The method of claim 12 including the steps of allowing said third layer to dry and form cracks and applying a fourth layer into said cracks and over said third layer.

14. The method of claim 12 wherein said second layer is allowed to dry and form cracks prior to the application of said third layer.

15. The method of claim 4, 7 or 10 including the step of forming a layer of solid salts over said coatings.

16. The method of claim 1 or 10 in which nonswelling sediments are employed and the dry, cracked layers are compacted prior to applying the final slurry.

17. A method of sealing a solar pond having a bottom covered with salt comprising:

applying a slurry having at least 35 weight percent soil particles of less than five micron to said salt to fill the interstices between the salt particles.

* * * * *

UNITED STATES PATENT OFFICE

CERTIFICATE OF CORRECTION

Patent No. 4,222,685 Dated September 16, 1980

Inventor(s) Gene Jefferson and Martin Laborde

It is certified that error appears in the above-identified patent and that said Letters Patent are hereby corrected as shown below:

On front page of the above patent, left-hand column under the paragraph designated as [73] Assignees: replace the first instance of "Corporation de Fomento de la Produccior" with --Saline Processors, Inc.--.

Signed and Sealed this

Ninth Day of December 1980

[SEAL]

Attest:

SIDNEY A. DIAMOND

Attesting Officer

Commissioner of Patents and Trademarks